US005800286A

United States Patent [19]

Kakiuchi et al.

[11] Patent Number: 5,800,286

[45] Date of Patent: Sep. 1, 1998

[54] GOLF BALL

[75] Inventors: Shinichi Kakiuchi; Yasushi Ichikawa; Takashi Maruko; Junji Umezawa, all of Chichibu; Kunitoshi Ishihara; Nobuhiko Matsumura, both of Izumiotsu, all of Japan

[73] Assignee: Bridgestone Sports Co., Ltd., Tokyo, Japan

[21] Appl. No.: 841,559

[22] Filed: Apr. 30, 1997

[30] Foreign Application Priority Data

May 1, 1996 [JP] Japan ..... 8-134250

[51] Int. Cl.[6] ..... A63B 37/12; A63B 37/06

[52] U.S. Cl. ..... 473/365; 473/371

[58] Field of Search ..... 473/365, 357, 473/371, 385, 354

[56] References Cited

U.S. PATENT DOCUMENTS 5,409,233 4/1995 Kennedy ..... 473/385

5,674,137 10/1997 Maruko et al. ..... 473/354

*Primary Examiner*—George J. Marlo

*Attorney, Agent, or Firm*—Sughrue, Mion, Zinn, Macpeak & Seas, PLLC

[57] ABSTRACT

A thread wound golf ball comprises a solid center and a wound core having a thread rubber layer formed by winding thread rubber around the center and a cover enclosing the wound core. The cover is based on a non-yellowing thermoplastic polyurethane elastomer, and the difference in specific gravity between the center and the cover is 0.2 or less.

3 Claims, 1 Drawing Sheet

GOLF BALL

CROSS REFERENCE TO RELATED APPLICATION

This application is an application filed under 35 U.S.C. § 111(a) claiming benefit pursuant to 35 U.S.C. § 119(e)(i) of the filing date of the Provisional Application Ser. No. 60/019,673 filed on Jun. 12, 1996 pursuant to 35 U.S.C. § 111(b).

BACKGROUND OF THE INVENTION

1. Field of the Invention

This invention relates to a thread wound golf ball wherein a wound core having a thread rubber layer formed around a solid center is encased in a cover and more particularly, to a thread wound golf ball which uses a high specific gravity non-yellowing thermoplastic polyurethane elastomer as cover stock so that the ball has an increased inertia moment, increased flying distance, and improved scuff resistance upon iron shots while discoloration of the cover surface is minimized.

2. Prior Art

Thread wound golf balls are conventionally manufactured by winding high elongation thread rubber on a liquid or solid center to form a thread rubber layer thereon and enclosing the thread rubber layer with a cover of balata rubber or ionomer resin.

Many professional and skilled golfers favor wound golf balls which present soft hitting feel and improved spin performance (or spin receptive) as compared with two-piece solid golf balls. The wound golf balls, however, have a drawback that they are inferior in flying distance to two-piece solid golf balls because the wound golf balls tend to fly sharply high due to back spin.

Therefore, development efforts have been made on wound golf balls in order to increase their carry. An attempt to increase the inertia moment of a golf ball is one of such efforts.

More particularly, the inertia moment of a golf ball largely affects the flight trajectory, flight distance, and control of the ball. In general, an increased inertia moment permits the golf ball to follow an elongated trajectory because the spin attenuation rate of the golf ball in flight is reduced so that the spin is maintained when the ball descends past the maximum altitude. Also when hit on the green with a putter, the ball will go straight and roll well. For these reasons, several proposals have been made on golf balls to impart a greater inertia moment thereto (see Japanese Patent Publication No. 73427/1993 and Japanese Patent Application Kokai (JP-A) Nos. 129072/1984 and 210272/1985). More specifically, it was proposed to blend a high specific gravity filler such as white barium sulfate and titanium oxide in an ionomer resin for increasing inertia moment (see JP-A 290969/1986).

In this proposal, however, the cover stock can be reduced in fluidity and in the case of wound golf balls, the cover is likely to penetrate into the thread rubber layer to detract -from durability. Also a loss of restitution and a reduced carry are problems while there occurs a phenomenon that the cover is scraped and fluffed.

It was also attempted to blend a heavy filler having a specific gravity of 8 or more such as tungsten in a cover. However, the adjustment by blending of a weight adjuster encounters a certain limit and cannot satisfy the whiteness required for the cover.

On the other hand, various investigations have been made on cover resins. There are known a number of attempts of using relatively inexpensive thermosetting polyurethane elastomers having pleasant feel and scuff resistance as a substitute for balata rubber or ionomer resins (see U.S. Pat. Nos. 4,123,061, 3,989,568, and 5,334,673).

Although the thermosetting polyurethane elastomers are improved in scuff resistance which is a drawback of a soft blend of ionomer resins, substantial efforts must be devoted for accomplishing mass scale production because complex steps of effecting curing reaction and the like are necessary after introduction of cover stock. Also, since thermosetting polyurethane elastomers have a slow rate of curing reaction when only an aliphatic isocyanate is used, partial use of an aromatic isocyanate is preferred to accelerate the rate of reaction. When aromatic isocyanate is used, the cover will yellow with the lapse of time. Even when white enamel paint is coated outside for opacifying purpose, the ball outer appearance changes its color tone as the urethane cover yellows.

Investigations have also been made on the covers of thermoplastic polyurethane elastomers (see U.S. Pat. Nos. 3,395,109, 4,248,432, and 4,442,282). Although the thermoplastic polyurethane elastomers improve the scuff resistance upon iron shots and moldability, they are currently not fully successful in increasing the carry by increasing inertia moment. There is a desire to have a golf ball of better performance and quality.

SUMMARY OF THE INVENTION

The present invention has been made in consideration of the above-mentioned circumstances and its object is to provide a wound golf ball of better performance and quality which will offer an increased flight distance due to an increased inertia moment and is improved in all of scuff resistance upon iron shots, discoloration, and moldability.

Making extensive investigations for attaining the above-mentioned object, the inventors have found in conjunction with a wound golf ball wherein a wound core having a solid center and a thread rubber layer formed by winding thread rubber around the center is encased in a cover that a high specific gravity cover stock is obtained using a non-yellowing thermoplastic polyurethane elastomer as a main resin component of cover stock and that when the difference in specific gravity between the center and the cover is reduced to 0.2 or less, the inertia moment is effectively increased and optimized so as to improve flight stability, achieving a significant increase of carry. The non-yellowing thermoplastic polyurethane elastomer used as the cover stock has advantages that it effectively prevents the ball surface from being fluffed or scraped upon iron shots because of improved scuff resistance, is easily moldable due to the thermoplastic nature, and minimizes yellowing of the cover surface with the lapse of time. The outstanding problems of the prior art are effectively solved.

Furthermore, when the cover has a hardness of 40 to 68 on Shore D hardness and the center is a solid center having a hardness of 1.6 to 4.4 mm as expressed by a distortion under an applied load of 30 kg, the carry can be more effectively increased. The present invention is predicated on this finding.

Accordingly, the present invention provides a thread wound golf ball comprising a solid center and a wound core having a thread rubber layer formed by winding thread rubber around the center and a cover enclosing the wound core, wherein said cover is based on a non-yellowing thermoplastic polyurethane elastomer, and the difference in specific gravity between the center and the cover is 0.2 or less.

DETAILED DESCRIPTION OF THE INVENTION

Figure 1:
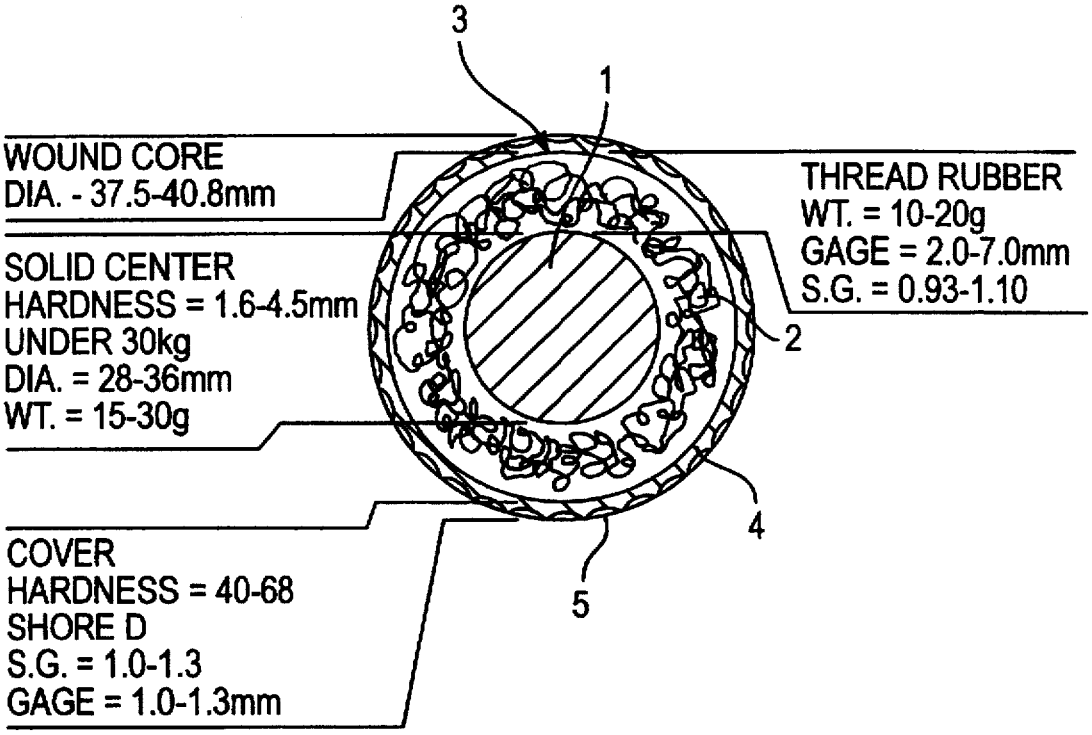
FIG. 1 is a cross-sectional view of a wound golf ball according to one embodiment of the invention.

The present invention is described below in further detail. The wound golf ball of the invention is shown in FIG. 1 as comprising a wound core 3 which has a solid center 1 and a thread rubber layer 2 formed by winding thread rubber around the center 1 and a cover 4 encasing the wound core 3 wherein a high specific gravity thermoplastic polyurethane elastomer is used as a main resin component of cover stock to reduce the difference in specific gravity between the center and the cover, thereby optimizing the inertia moment of the ball.

The thermoplastic polyurethane elastomer used as a main resin component of cover stock is a non-yellowing thermoplastic polyurethane elastomer since the yellowing resistance at the ball surface is taken into account. Especially preferred are thermoplastic polyurethane elastomers having an aliphatic diisocyanate, for example, PANDEX T-R3080 and T-7890 (trade name, manufactured by Dai-Nihon Ink Chemical Industry K.K.).

More particularly, the thermoplastic polyurethane elastomer has a molecular structure consisting of a high molecular weight polyol compound constituting a soft segment, a monomolecular chain extender constituting a hard segment, and a diisocyanate.

The high molecular weight polyol compound includes polyester polyols, polycarbonate polyols and polyether polyols although it is not limited thereto. Exemplary polyester polyols are polycaprolactone glycol, poly(ethylene-1,4-adipate) glycol, poly(butylene-1,4-adipate) glycol, and poly (diethylene glycol adipate) glycol; an exemplary polycarbonate polyol is (hexane diol-1,6-carbonate) glycol; and an exemplary polyether polyol is polyoxytetramethylene glycol. They have a number average molecular weight of about 600 to 5,000, preferably 1,000 to 3,000.

The diisocyanate used herein is preferably an aliphatic diisocyanate in consideration of the yellowing resistance of the cover. Examples are hexamethylene diisocyanate (HDI), 2,2,4- or 2,4,4-trimethylhexamethylene diisocyanate (TMDI), and lysine diisocyanate (LDI), with the hexamethylene diisocyanate (HDI) being especially preferred.

The chain extenders are not critical and conventional polyhydric alcohols and amines may be used. Examples include 1,4-butylene glycol, 1,2-ethylene glycol, 1,3-propylene glycol, 1,6-hexyl glycol, 1,3-butylene glycol, dicyclohexylmethane diamine (hydrogenated MDA), and isophorone diamine (IPDA).

Another thermoplastic resin may be blended in the thermoplastic polyurethane elastomer if desired. Examples of the thermoplastic resin used herein include polyamide elastomers, polyester elastomers, ionomers, styrene block elastomers, hydrogenated butadiene, and ethylene-vinyl acetate copolymers (EVA).

In addition to the above-mentioned resin components, various additives, for example, pigments, dispersants, antioxidants, UV absorbers, and mold release agents may be added to the cover stock in conventional amounts, if necessary.

The specific gravity, hardness, and gage of the cover 4 may be suitably adjusted insofar as the object of the invention is attainable. Usually, the cover has a specific gravity of 1.0 to 1,3, especially 1.1 to 1.25, a hardness of 40 to 68, especially 45 to 55 as measured by a Shore D durometer (to be referred to as Shore D hardness, hereinafter), and a gage of 1.0 to 3.0 mm, especially 1.0 to 1.8 mm.

Next, the solid center 1 can be prepared by well-known methods from a well-known material using an elastomer comprising cis-1,4-polybutadiene as a main component.

The solid center should have a greater specific gravity than the cover. The center and the cover are preferably formed such that the difference in specific gravity therebetween is up to 0.2, more preferably 0.0 to 0.15. A specific gravity difference in excess of 0.2 would not allow the effect of increased inertia moment to be fully exerted, failing to increase the carry.

It is noted that the diameter, weight, and hardness of the solid center 1 are not critical although the solid center usually has a diameter of 28 to 36 mm, especially 30 to 34 mm, a weight of 15 to 30 grams, especially 17 to 28 grams, and a hardness of 1.6 to 4.5 mm, especially 1.8 to 4.0 mm as expressed by a distortion under an applied load of 30 kg.

Next, the thread rubber layer 2, which is prepared by winding thread rubber around the center 1 under high tension, usually has a weight of 10 to 20 grams, especially 12 to 18 grams and a gage of 2.0 to 7.0 mm, especially 3.0 to 6.0 mm.

Conventional techniques may be employed in winding thread rubber while thread rubber of a well-known composition may be used. Although the thread rubber is not limited with respect to specific gravity, dimensions and gage, it usually has a specific gravity of 0.93 to 1.10, especially 0.93 to 1.0, and as to the dimensions of thread rubber, its width is 1.4 to 2.0 mm, especially 1.5 to 1.7 mm, and its gage is 0.3 to 0.7 mm, especially 0.4 to 0.6 mm.

The wound core 3 consisting of the center 1 and the thread rubber layer 2 may have a diameter of 37.5 to 40.8 mm, especially 39.0 to 40.6 mm.

For encasing the wound core 3 in the cover 4, techniques as used with conventional ionomer resin covers may be generally employed, for example, a technique of directly injection molding the cover stock about the wound core 3, and a technique of previously forming a pair of hemispherical half cups from the cover stock, enclosing the wound core 3 with these half cups, and effecting heat pressure molding at 140° to 180° C. for 2 to 10 minutes.

Like conventional golf balls, the wound golf ball of the invention is formed with a multiplicity of dimples in the surface. The indexes and arrangement of dimples are optimized for the purpose of further improving the flight performance resulting from the increased inertia moment.

First, the golf ball of the invention is formed with dimples such that, provided that the golf ball is a sphere defining a phantom spherical surface, the proportion of the surface area of the phantom spherical surface delimited by the edge of respective dimples relative to the overall surface area of the phantom spherical surface, that is, the percent occupation of the ball surface by dimples is at least 65%, preferably 70 to 80%. With a lower dimple occupation of less than 65%, the above-mentioned improved flight properties, especially increased carry would be lost.

Secondly, a percent dimple volume is calculated as (overall dimple volume)/(ball volume)×100%. The ball volume is the volume of a true spherical ball assuming that the golf ball has no dimples in its surface and the overall dimple volume is the sum of the volumes of respective dimples. The percent dimple volume is 0.76 to 0.9%, preferably 0.78 to 0.88%, more preferably 0.8 to 0.86%. A percent dimple volume of less than 0.76% would invite a too high trajectory resulting in a shorter carry whereas a percent dimple volume of more than 0.9% would invite a too low trajectory, also resulting in a shorter carry.

The number of dimples is 350 to 500, preferably 370 to 480, more preferably 390 to 450. When the number of dimples is less than 350, each dimple must have a larger diameter, adversely affecting the sphericity of the ball. When the number of dimples is more than 500, each dimple must have a smaller diameter, sometimes losing the dimple effect. No particular limit is imposed on the diameter and depth of dimples. Usually the dimples have a diameter of 1.4 to 2.2 mm and a depth of 0.15 to 0.25 mm. There may be formed two or more types of dimples which are different in diameter and/or depth. The arrangement of dimples is not critical. Any of conventional dimple arrangements such as regular octahedral, regular dodecahedral, and regular icosahedral arrangements may be employed. Furthermore, the pattern formed on the ball surface by the dimple arrangement may be any desired one such as square, hexagon, pentagon, and triangle patterns.

While the golf ball of the invention has the above-mentioned construction, the ball hardness is preferably 2.4 to 3.6 mm, especially 2.6 to 3.4 mm as expressed by a distortion under a load of 100 kg.

It is understood that golf games are played under the common Rules of Golf over the world. It is, of course, prerequisite that with respect to weight, diameter, symmetry, and initial velocity, the golf ball of the invention should have, according to the Rules of Golf, a weight of not greater than 45.93 grams, a diameter of not less than 42.67 mm, and an initial velocity properly tailored so as to be not greater than 76.2 m/sec. when measured on apparatus approved by the R & A (a maximum tolerance of 2% (77.7 m/sec.) will be allowed and the temperature of the ball when tested shall be 23±1° C.).

There has been described a wound golf ball of better performance and quality which has a high specific gravity cover due to the use of a non-yellowing thermoplastic polyurethane elastomer as a main component of cover stock and which will travel an increased carry due to an increased inertia moment and is improved in all of scuff resistance upon iron shots, discoloration, and moldability.

EXAMPLE

Examples of the invention are given below together with comparative examples by way of illustration and not by way of limitation.

Examples & Comparative Examples

Six solid centers A to F were molded by milling the solid center composition shown in Table 1 and molding and vulcanizing it in a mold at 150° C. for 15 minutes.

The solid centers were measured for diameter, weight, specific gravity, and hardness (a distortion under an applied load of 30 kg). The results are shown in Table 3. It is noted that the amounts of components blended for the solid center are expressed by parts by weight.

TABLE 1

| Solid center | A | B | C | D | E | F |
|---|---|---|---|---|---|---|
| Cis-1,4-poly-butadiene*1 | 100 | 100 | 100 | 100 | 100 | 100 |
| Zinc acrylate | 20 | 20 | 20 | 20 | 20 | 24 |
| Zinc oxide | 20 | 22 | 20 | 30 | 31 | 19 |
| Barium sulfate | 25 | 26 | 21 | 36 | 35 | 23 |
| Dicumyl peroxide | 1.2 | 1.2 | 1.2 | 1.2 | 1.2 | 1.2 |
| Center diameter (mm) | 31.9 | 31.9 | 31.9 | 31.9 | 31.9 | 31.9 |
| Center weight (g) | 21.4 | 21.8 | 20.8 | 23.5 | 21.8 | 23.5 |
| Center specific gravity | 1.26 | 1.28 | 1.24 | 1.38 | 1.29 | 1.26 |
| Center hardness (mm) | 1.95 | 1.97 | 1.93 | 1.88 | 1.86 | 1.42 |

*1trade name: BR01 manufactured by Nihon Synthetic Rubber K.K.

Thread rubber of the formulation shown below was wound on the solid centers by a conventional winding technique, obtaining wound cores. The wound cores have a diameter of 39.8 mm.

| Thread rubber formulation and parameters | |
|---|---|
| Polyisoprene rubber | 70 pbw |
| Natural rubber | 30 pbw |
| Zinc white | 1.5 pbw |
| Stearic acid | 1 pbw |
| Vulcanization promoter | 1.5 pbw |
| Sulfur | 1 pbw |
| Specific gravity: 0.93 | |
| Thread rubber size: width 1.55 mm, gage 0.55 mm | |

Next, the cover components shown in Table 2 were milled into cover compositions A to F, which were respectively molded into a pair of hemispherical half cups.

TABLE 2

| | A | B | C | D | E | F |
|---|---|---|---|---|---|---|
| PANDEX T-7890*2 | 100 | — | — | — | — | — |
| PANDEX T-R3080*2 | — | 100 | — | — | — | — |
| PANDEX T-1198*3 | — | — | 100 | — | — | — |
| HIMILAN 1706*4 | — | — | — | 50 | 50 | — |
| SURLYN 8120*5 | — | — | — | 50 | 50 | 100 |
| Barium sulfate | — | — | — | — | 20 | — |
| Titanium oxide | 5 | 5 | 5 | 5 | 5 | 5 |
| Magnesium stearate | 0.5 | 0.5 | 0.5 | 0.5 | 0.5 | 0.5 |
| Specific gravity | 1.18 | 1.19 | 1.24 | 0.97 | 1.13 | 0.97 |
| Shore D hardness | 43 | 42 | 53 | 54 | 55 | 45 |

*2non-yellowing thermoplastic polyurethane elastomer, manufactured by Dai-Nihon Ink Chemical Industry K.K.
*3ordinary thermoplastic polyurethane elastomer, manufactured by Dai-Nihon Ink Chemical Industry K.K.
*4ionomer resin, manufactured by Mitsui-duPont Polychemical K.K.

Wound golf balls of Examples 1 to 4 and Comparative Examples 1 to 3 were obtained by encasing the wound cores A to F in the half cups of cover compositions A to F in the combination shown in Table 3 and effecting heat pressure molding at 160° C. and 120 kg/cm$^2$ for 5 minutes. The thus obtained golf balls had dimples formed in their surface with a dimple number of 396 (including two types of large and small dimples), a percent surface occupation by dimples of 75%, and a percent dimple volume of 0.85%.

The golf balls were evaluated for various properties by the following tests. The results are also shown in Table 3.

Ball hardness

A distortion (mm) of a ball under a load of 100 kg was measured. Higher values indicate softer balls.

Flight test

Using a swing robot machine and a No. 1 wood (driver) club, a ball was actually hit at a head speed of 45 m/sec. (HS45) to measure a spin rate, initial velocity (measured in accordance with the procedure prescribed in USGA or R&A), elevation angle, carry and total distance.

Scraping resistance

Using a swing robot machine and a sand wedge (SW) club, a ball was actually hit at a head speed of 33 m/sec. at arbitrary two positions, one hit on each position. The two hit sites were visually observed to make evaluation according to the following criterion.

O: Good

X: Poor

Discoloring test

Using a mercury lamp tester (manufactured by Suga Tester K.K.) equipped with a fadeometer mercury lamp H400-F manufactured by Toshiba K.K., a ball was illuminated for 24 hours. A change of Lab color space on the ball surface was measured by means of a multi-light source spectrophotometer MSC-IS-2DH (manufactured by Suga Tester K.K.). For the Lab color space, values of L, a, and b were determined in accordance with JIS Z8701.

In the Lab color space, L stands for a brightness which represents whether a color is bright or dark, that is, lightness index. Larger values of L indicate lighter color, with L values of 90 or more being preferred. Also, a and b stand for chromaticity in red-green direction and yellow-blue direction, respectively. Therefore, for a, larger values indicate more reddish color and smaller values indicate more greenish color. For b, larger values indicate more yellowish color and smaller values indicate more bluish color.

A color difference $\Delta E$ is calculated from the values of Lab color space of the ball before and after illumination by the mercury lamp. More particularly, the Lab color space (L1, a1, b1) before illumination and the Lab color space (L2, a2, b2) after illumination were measured, their differences $\Delta L=L1-L2$, $\Delta a=a1-a2$, and $\Delta b=b1-b2$ were calculated, a color difference $\Delta E$ before and after illumination was calculated according to $\Delta E=(\Delta L^2+\Delta a^2+\Delta b^2)^{1/2}$, and evaluation was made according to the following criterion.

O: color difference $\Delta E \leqq 3.5$

X: color difference $\Delta E > 3.5$

TABLE 3

| | | E1 | E2 | E3 | E4 | CE1 | CE2 | CE3 | CE4 |
|---|---|---|---|---|---|---|---|---|---|
| Center | Type | A | A | B | F | C | D | E | D |
| | Specific gravity A | 1.26 | 1.26 | 1.39 | 1.26 | 1.24 | 1.38 | 1.29 | 1.38 |
| | Hardness (mm) | 1.95 | 1.95 | 1.93 | 1.42 | 1.93 | 1.88 | 1.86 | 1.88 |
| Cover | Type | A | B | B | A | C | D | E | F |
| | Specific gravity B | 1.18 | 1.19 | 1.19 | 1.18 | 1.24 | 0.97 | 1.13 | 0.97 |
| | Shore D hardness | 43 | 42 | 42 | 43 | 53 | 54 | 55 | 45 |
| | Specific gravity difference (A − B) | 0.08 | 0.07 | 0.20 | 0.08 | 0.0 | 0.41 | 0.16 | 0.41 |
| Ball | Diameter (mm) | 42.68 | 42.68 | 42.68 | 42.68 | 42.69 | 42.68 | 42.69 | 42.69 |
| | Weight (gram) | 45.2 | 45.3 | 45.6 | 45.2 | 45.2 | 45.2 | 45.3 | 45.3 |
| | Hardness (mm) | 3.05 | 3.01 | 3.02 | 3.02 | 3.01 | 3.03 | 3.03 | 3.05 |
| W#1/HS = 45 | Spin (rpm) | 2950 | 2950 | 2980 | 3100 | 2850 | 2950 | 2970 | 3060 |
| | Initial velocity (m/s) | 65.5 | 65.5 | 65.5 | 65.3 | 65.4 | 65.5 | 65.1 | 65.0 |
| | Elevation angle (°) | 12.0 | 12.0 | 11.8 | 12.1 | 11.8 | 11.9 | 11.8 | 11.9 |
| | Carry (m) | 206.8 | 206.4 | 205.7 | 205.5 | 205.7 | 204.1 | 203.5 | 205.1 |
| | Total distance (m) | 218.8 | 220.3 | 219.4 | 215.5 | 221.3 | 218.7 | 216.2 | 215.8 |
| Scraping resistance | | o | o | o | o | o | x | x | x |
| Discoloration | | o | o | o | o | x | o | o | o |

It is evident from the results of Table 3 that the balls of Comparative Examples 2 to 4 are poor in scraping resistance and travel less satisfactory distances because no non-yellowing thermoplastic polyurethane elastomer is used as the cover in Comparative Examples 2 to 4 and especially because the difference in specific gravity between the center and the cover is as large as 0.41 in Comparative Examples 2 and 4. The ball of Comparative Example 1 is poor in discoloration because an ordinary thermoplastic polyurethane elastomer is used as the cover In contrast, the balls of Examples 1 to 4 travel increased distances and are improved in scraping resistance and discoloration because a high specific gravity, non-yellowing thermoplastic polyurethane elastomer is used as a main component of the cover stock so as to reduce the difference in specific gravity between the center and the cover to 0.2 or less.

We claim:

1. A thread wound golf ball comprising a solid center and a wound core having a thread rubber layer formed by winding thread rubber around the center and a cover enclosing the wound core, wherein said cover is based on a non-yellowing thermoplastic polyurethane elastomer, and the difference in specific gravity between the center and the cover is 0.2 or less.

2. The thread wound golf ball of claim 1 wherein said cover has a Shore D hardness of 40 to 68.

3. The thread wound golf ball of claim 1 wherein said solid center has a diameter of 28 to 36 mm and a distortion of 1.6 to 4.4 mm under a load of 30 kg.

* * * * *